US005090589A

United States Patent [19]

Brandes et al.

[11] Patent Number: 5,090,589

[45] Date of Patent: Feb. 25, 1992

[54] COIN-OPERATED VENDING MACHINE

[75] Inventors: John H. Brandes, Atlanta; Eddie W. King, Marietta; Don S. Summerville, Snellville, all of Ga.

[73] Assignee: The Coca-Cola Company, Atlanta, Ga.

[21] Appl. No.: 17,099

[22] Filed: Feb. 20, 1987

Related U.S. Application Data

[62] Division of Ser. No. 623,123, Jun. 22, 1984, Pat. No. 4,682,709.

[51] Int. Cl.[5] ..... G07F 9/02

[52] U.S. Cl. ..... 221/2; 40/541; D20/5

[58] Field of Search ..... 221/2, 24, 155, 286, 221/125, 129, 150 R; 194/350; 312/234.1; 222/146.2, 78; 40/331, 332, 541-545, 584; 369/37; D20/4, 5

[56] References Cited

U.S. PATENT DOCUMENTS

| | | | |
|---|---|---|---|
| D. 110,511 | 7/1938 | Young . | |
| D. 145,609 | 9/1946 | Bach . | |
| D. 290,619 | 6/1987 | Brandes et al. . | |
| 1,897,072 | 2/1933 | Parks et al. | 194/344 |
| 2,392,511 | 1/1946 | Thompson et al. | 194/240 |
| 2,476,877 | 7/1949 | Knott et al. | 221/129 |
| 4,011,931 | 3/1977 | Wyckoff | 194/206 |
| 4,326,620 | 4/1982 | Felix et al. | 194/344 |
| 4,380,130 | 4/1983 | Bachmann et al. | 40/584 |
| 4,454,670 | 6/1984 | Bachmann et al. | 194/350 |

FOREIGN PATENT DOCUMENTS 320530 10/1929 United Kingdom .

*Primary Examiner*—F. J. Bartuska
*Attorney, Agent, or Firm*—Birch, Stewart, Kolasch & Birch

[57] ABSTRACT

A vending machine for beverage containers comprising a frame having front, side and rear faces; a bowed sign panel substantially covering the front face and extending outwardly therefrom, said sign panel being fabricated from transparent materials with translucent display fields thereon; illumination means disposed behind the bowed sign panel for backlighting the same; a control panel disposed within the bowed sign panel; and a discharge port for presenting beverage container to customers through the bowed sign panel. The bowed sign panel contains a product-identifying logo thereon corresponding to at least one type of beverage can, such as a primary product to be vended, the logo being displaced on the signal panel in the same manner as the logo on the primary product beverage can. The curved or bowed shape of the sign panel is such that the overall appearance and configuration of the vending machine, viewed from the front face thereof, suggests the appearance of a can of beverage of the primary product.

6 Claims, 2 Drawing Sheets

COIN-OPERATED VENDING MACHINE

This application is a divisional of copending application Ser. No. 623,123, filed on June 22, 1984 now U.S. Pat. No. 4,682,709.

BACKGROUND OF THE INVENTION

The present invention relates to a coin-operated vending machine for soft drink bottles or cans. More specifically, the present invention relates to a vending machine with increased illumination for sign panels thereof, creative styling for increasing product sales and interactive customer communication functions for inducing higher sales and simplifying the operation of the machine.

In recent years, substantial improvements have been made to vending machines, including increased illumination of sign panels, creative styling in connection therewith, and the inclusion of devices for providing interactive customer communication, all of which are useful in increasing the sales of products to be vended. Examples of these recent developments of vending machines in connection with improved styling are disclosed in U.S. Pat. No. 4,380,130 to Bachmann, et al., issued Apr. 19, 1983, and U.S. Pat. No. 4,414,768 also to Bachmann, et al., issued Nov. 15, 1983. In the first Bachmann patent, the sign panel on the obverse face of the vending machine is configured in the shape of the first letter or abbreviation of the primary product to be vended, to provide a dominance of the primary product and induce the sales thereof. In the second Bachmann patent, an enlarged, primary product selection button is provided and disposed immediately adjacent to the coin slot of the machine, which also tends to induce and increase the sales of the primary product to be vended. Both of the above patents have been very successful in achieving their objectives of increasing product sales. Both of these patents are assigned to the same assignee as the present invention An additional advance in the vending machine art is exemplified by U.S. Pat. No. 4,454,670 to Bachmann, et al. , issued June 19, 1984. This patent discloses a plurality of interchangeable utility module devices, all of which provide interactive customer communication, either by way of instructions to the customer with respect to vending machine operation, advertising with respect to products to be vended or video games which involve the customer in the operation and use of the vending machine. These interactive communications are disclosed as being either audio or visual. This patent is also assigned to the same assignee as the present invention.

As stated above, these vending machines have been very successful in the marketplace with respect to achieving their objectives. However, there is room for some improvement with respect to these machines in the level and uniformity of illumination of the sign panel, the overall styling, and the provision of adequate space behind the sign panel and obverse face of the vending machine for housing the various devices which provide the interactive customer communication functions.

SUMMARY OF THE INVENTION

Accordingly, it is a primary object of the present invention to provide a coin-operated vending machine with increased visibility and uniform lighting with respect to the sign panel on the obverse face thereof.

It is another object of the present invention to provide a sign panel which is so shaped that it can be made thinner than a flat sign panel of the same material, while maintaining sufficient structural strength.

It is a further object of the present invention to provide a vending machine wherein all dispenser openings for objects such as vended products, change and redeemable coupons, are located in a common area below the product selector buttons for customer convenience.

It is still a further object of the present invention to provide a sign panel for the obverse face of a vending machine which is so shaped that it provides increased room for the location of interactive customer communication devices and other related controls.

It is still another object of the present invention to provide a vending machine wherein the overall machine configuration and appearance suggests the appearance of a can of the product corresponding to a primary product to be vended in the machine.

These and other objects of the present invention are fulfilled by providing a vending machine for beverage containers comprising a frame having front, side and rear faces; a bowed sign panel substantially covering the front face and extending outwardly therefrom, said sign panel being fabricated from transparent materials with translucent display fields thereon; illumination means disposed behind the bowed sign panel for backlighting the same; a control panel disposed within the bowed sign panel; and a discharge port for presenting beverage containers to customers through the bowed sign panel.

In a preferred embodiment, the beverage containers to be dispensed are cans, and the sign panel contains a product-identifying logo thereon corresponding to at least one type of beverage cans, such as a primary product to be vended, the logo being displayed on the sign panel in the same manner as the logo on the primary product beverage can. The curved or bowed shape of the sign panel is such that the overall appearance and configuration of the vending machine, viewed from the front face thereof, suggests the appearance of a can of beverage of the primary product.

The bowed shape of the sign panel is advantageous in achieving uniform illumination of the sign panel from a plurality of light sources disposed therebehind.

More uniform lighting is achieved because the bowed configuration of the sign panel provides substantially equidistant spacing between the light sources which backlight the panel. This is true because with a cylindrical light source, light is emitted from a curved surface which approximates the curve of the sign panel. Therefore, all portions of the curved or bowed sign panel are subjected to backlighting of substantially the sam intensity.

In an alternative embodiment of the present, one side of the vending machine may also be provided with a backlighted sign panel for the display of additional advertising in connection with the sale of vended products. This may comprise a rectangular light box, removably attached to that side of the vending machine which forms a flush interconnection with one edge of the bowed sign panel to define a front corner of the vending machine.

The control panel of the vending machine of the present invention and the associated interactive customer communication devices are provided in a central, flat section of the bowed sign panels in vertical alignment above the discharge port of the vending machine. All of the interactive customer communications devices are disposed above the coin slot or dollar bill validator slot of the vending machine. Just below the coin slot and dollar bill validator is a selector button array, including an enlarged primary product selection button overlying a pair of vertical columns of secondary product selector buttons. A coupon dispenser is provided adjacent the discharge port below the product selector button array and includes a discharge slot in a common escutcheon plate with the discharge port for vending redeemable coupons to a customer along with the vend of a product. Also provided within the same escutcheon plate is a coin return slot. With the above grouping of controls, interactive customer communication devices and dispenser slot openings, all devices involved in the operation of the machine during a typical vend cycle, are conveniently grouped to provide devices of similar functions in common locations. In addition, these groups are located from top to bottom in the vending machine in a logical sequence, so that all initial functions of a vend cycle begin adjacent to the coin slot at the top of the machine and progress toward the discharge port at the bottom where products are vended, coupons are dispensed and coins are returned.

BRIEF DESCRIPTION OF THE DRAWINGS

The objects of the present invention and the attendant advantages thereof will become more readily apparent by reference to the drawings wherein.

DETAILED DESCRIPTION OF PREFERRED EMBODIMENT

Figure 2:
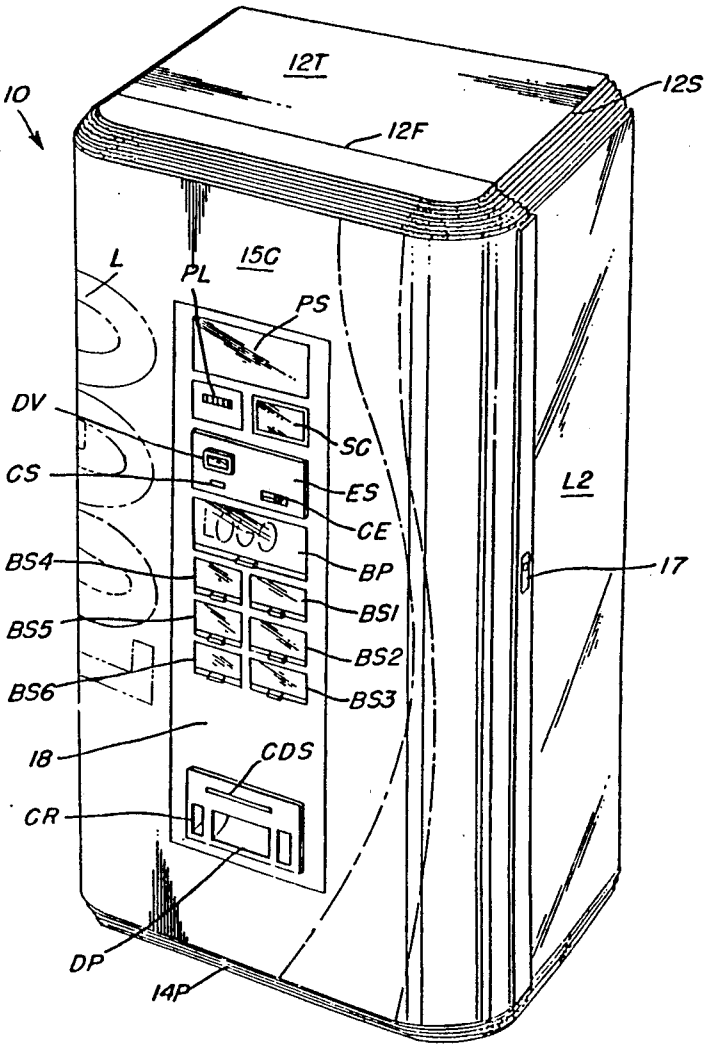
FIG. 2 is a top and right front perspective view of the vending machine of the present invention.
Figure 1:
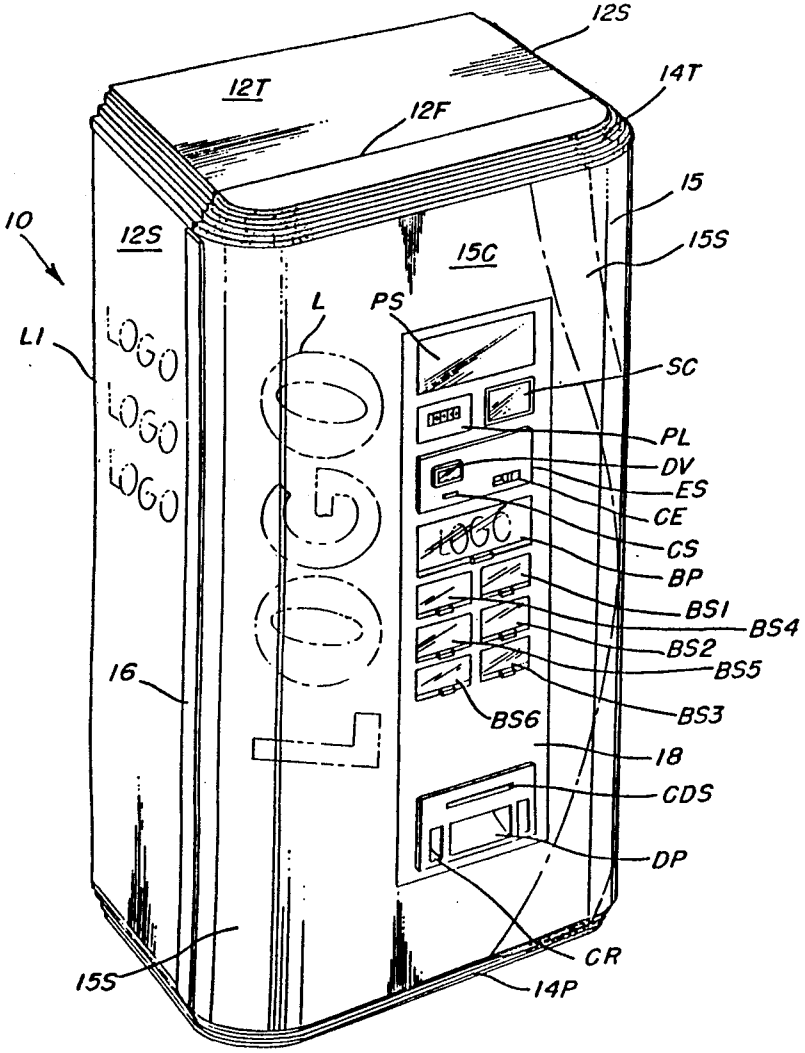
FIG. 1 is a top and left front perspective view of the vending machine according to the present invention.

Referring to FIGS. 1 and 2, the vending machine 10 of the present invention is generally illustrated as a substantially rectangular, three-dimensional cabinet including a frame with sides 12S, a front 12F, and a top 12T. A front door of the vending machine is provided with a hinge strip 16 along one vertical edge thereof and a latch 17 on the opposite vertical edge. The door includes a bowed, transparent plastic panel 15 fabricated from polycarbonate or the like, such as LEXAN, which is supported within upper and lower door frame members 14T and 14B, respectively Suitable transparent art work and coloring is silk screened on the rear of bowed sign panel 15 to define translucent display fields. This includes red and white coloring configured to display the primary product logo or trademark. The bowed panel 15 has a substantially flat, central portion 15C and curved side portions 15S.

The substantially flat, central portion 15C of the bowed panel has a control panel formed therein of a type similar to that disclosed in prior U.S. patent application Ser. No. 557,320 to King, et al., filed Dec. 2, 1983, and assigned to the same assignee as the present invention. The disclosure of that application is incorporated herein by reference. Rectangular area 18 is silk-screened with a dark red, substantially opaque material to increase contrast with transparent windows which are left in the control panel at the rectangular areas PS, PL, SC, BP, and BS1–BS6. Window S is provided for displaying appropriate point-of-sale advertising which may be in the form of translucent adhesive stickers disposed behind panel 15 and backlighted to project images of the point-of-sale information through the window PS. Window PL may be provided for displaying pricing information or special instructions in connection with the initiation of a vend. The instruction information may also be provided by backlighting an appropriate sticker from within the vending machine and projecting the information through window PL. Window SC may be provided for the screen of a video game or a cathode ray tube utilized for displaying audio visual advertisements to customers in the vicinity of the machine. A 11 of the above provide interactive communication between customers and the vending machine.

The escutcheon plate ES is provided with a dollar bill validator slot DV, a coin slot CS, and a coin ejector CE.

Figure 3:
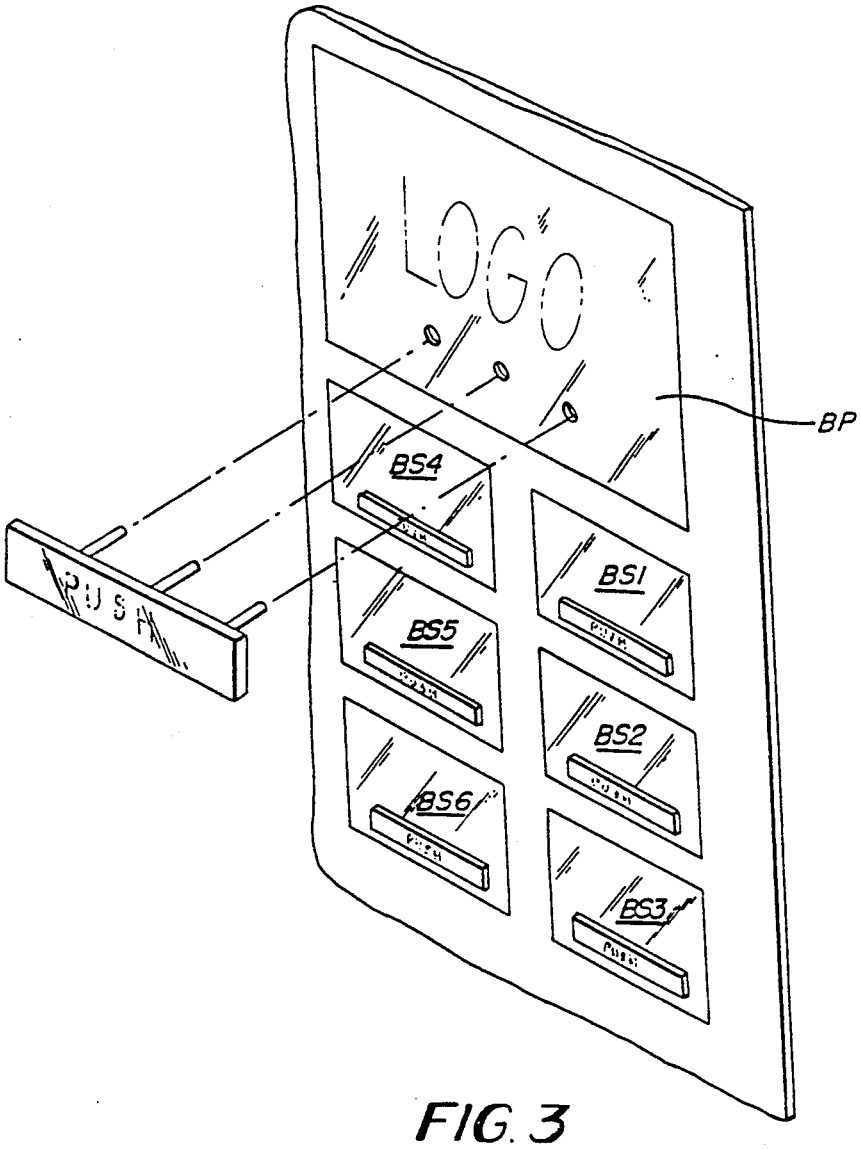
FIG. 3 is an enlarged fragmentary view of the product selector button array of the vending machine of FIGS. 1 and 2.

The product selector button array of the control panel of the present invention preferably includes a primary product display window BP associated with the primary product to be vended, and a plurality of secondary product selector windows BS1 to BS6, disposed in vertical columns underlying the primary product display window BP. Each of these windows has a touch-sensitive, push bar, actuator switch associated therewith such as those disclosed in the aforementioned King application, Ser. No. 557,320, filed Dec. 2, 1983. The product selector button array of a control panel of the present invention is illustrated in more detail in the enlarged fragmentary view of FIG. 3.

The vending machine of the present invention is provided with a discharge port DP defined within a suitable escutcheon plate adjacent the bottom of the vending machine. Within the same escutcheon plate and adjacent to the discharge port is a coupon dispenser slot CDS for dispensing redeemable coupons in association with the vend of a product as a further inducement to increase product sales. Also disposed within the same escutcheon plate adjacent to the discharge port DP is a coin return slot CR.

Figure 4:
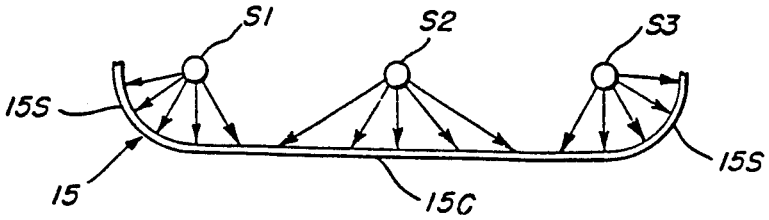
FIG. 4 is a diagrammatic illustration of the backlighting illumination system utilized with the vending machine of the present invention.

FIG. 4 illustrates the manner in which bowed sign panel 15 is illuminated from the rear thereof in order to fully and uniformly illuminate the same. As illustrated in FIG. 4, three light sources S1, S2, S3 are provide, S1 and S3 being disposed behind curved side portions 15S of bowed sign panel 15. It can be seen from the illustration in FIG. 4 that the light beams given off by each of light sources S1 and S3 traverse substantially equal distances to the sign panel portions 15S, because of the complimentary curvature of the cylindrical sources S1 and S3 and the curved portions 15S. Therefore, these curved portions are uniformly illuminated, improving the quality and illumination level of the display, as viewed from the obverse face of the bowed sign panel 15. The light sources S1, S2 preferably comprise elongated, fluorescent light tubes which extend along substantially the entire vertical length of the bowed sign panel 15. The central light source S2 is provided primarily for backlighting the control panel and the associated product selector buttons illustrated in FIG. 3, as well as for backlighting any point-of-sale information or instructions within transparent windows PS and PL, described hereinbefore.

The bowed sign panel 15 of the present invention provides some distinct advantages over previously used flat sign panels in that the curved, backlighted sign panel 15 dramatically increases the visibility of the vendor and contributes to the uniform lighting effect, as illustrated in FIG. 4. In addition, the bowed sign panel 15 of the present invention increases the structural strength of the sign panel, as compared to a flat panel, and allows a reduction in material thickness. Furthermore, the bowed shape of sign panel 15 provides a concave space or pocket behind sign panel 15 in which control circuitry and devices associated with the interactive customer communication devices, the coupon dispenser, and so forth, may be disposed without interfering with the space provided in the normal three-dimensional, rectangular vending machine frame.

The bowed sign panel 15 provides the additional advantage in that the entire vending machine as viewed from the front suggests the shape of a can of beverage and, in conjunction with the logo thereon which is disposed in a similar manner as on a can of the primary product to be vended, it suggests the appearance of a can of that primary product.

The vending machine of the present invention also provides an advantageous location of the components of the control panel, the coupon dispenser slot CDS, the coin return slot CR, and the discharge port DP. These components are disposed in functional groups so that a customer approaching the vending machine should first direct his attention to the coin slot and the windows thereabove during the entry of a required coin or dollar bill into the dollar bill validator. The customer then makes an appropriate selection on one of the selector buttons, and when a product is vended to the discharge port DP, the customer bends over to simultaneously and conveniently retrieve a beverage product, a coupon from slot CD S and/or change from coin return slot CR. Stated another way, all of the interactive customer communication devices are disposed above the coin slot, the product selection panel is disclosed directly below and adjacent to the coin slot, and all articles to be vended, or discharged from the vending machine, are dispensed in the region of the discharge port DP. This is a very efficient and functional arrangement of the components on the face of the vending machine which dictates a logical and convenient sequence of operations by a user of the vending machine.

Additional illumination may be achieved with the use of an optional backlighted sign panel L2, as illustrated in FIG. 2. Panel L2 may be removably secured to the right face of the vending machine frame. It may have translucent advertising material or logo thereon and be backlighted. If a panel L2 is used, the front door, inclusive of bowed panel 15, must be wider to allow for the thickness of panel L2 and the backlighting devices therefor. Additional logo such as L1 may also be provided on the left side face of the vending machine.

It should be understood that the vending machine described herein may be modified as would occur to one of ordinary skill in the art without departing from the spirit and scope of the present invention.

What is claimed is:

1. A vending machine for beverage containers comprising:

a) a frame having front, side and rear faces;

b) a bowed sign panel having a substantially continuous obverse surface substantially covering the front face and extending outwardly therefrom, said sign panel being fabricated from transparent material and having translucent display fields formed thereon;

c) illumination means disposed behind said bowed sign panel for backlighting the same, said illuminating means including a plurality of elongated cylindrical light sources having longitudinal axes extending vertically of said sign panel, the cylindrical curvature of said light sources about said longitudinal axes approximating the curvature of portions of said bowed sign panel;

d) a control panel disposed adjacent the sign panel; and e) a discharge port for presenting said beverage containers to customers through said front face.

2. The vending machine according to claim 1, wherein the beverage containers are cans and said sign panel contains product identifying logo thereon corresponding to at least one type of beverage can to be vended, said logo being displayed on said sign panel in a similar manner to the logo on said beverage can, and said bowed sign panel being so shaped that the entire vending machine viewed from the front face suggests the appearance of said beverage can.

3. The vending machine according to claim 1, wherein said cylindrical light sources are substantially evenly spaced with respect to each other horizontally of the sign panel to provide even illumination of the entire sign panel.

4. The vending machine according to claim 1, wherein said discharge port is disposed within a central portion of said sign panel.

5. The vending machine according to claim 1, wherein said control panel includes a plurality of spaced product selection areas disposed in a column extending vertically of said sign panel.

6. A vending machine for beverage containers comprising:

a) a frame having front, side and rear faces;

b) a bowed sign panel having a substantially continuous obverse surface substantially covering the front face and extending outwardly therefrom, said sign panel being fabricated from transparent material and having translucent display fields thereon;

c) illumination means disposed behind said bowed sign panel for backlighting the same, said illumination means including a plurality of elongated, cylindrical light sources having longitudinal axes extending vertically of said sign panel, the cylindrical curvature of said light sources about said longitudinal axes approximating the curvature of portions of said bowed sign panel, said cylindrical light sources being substantially evenly spaced with respect to each other horizontally of the sign panel to provide even illumination of the entire sign panel;

d) a control panel disposed adjacent the bowed sign panel, said control panel including a plurality of spaced product selection areas disposed in a column extending vertically of said sign panel; and e) a discharge port disposed in a central area of said sign panel for presenting said beverage containers to customers through said bowed sign panel.

* * * * *